US011044958B1

(12) United States Patent
Mason et al.

(10) Patent No.: US 11,044,958 B1
(45) Date of Patent: Jun. 29, 2021

(54) FACE COVERING WITH INTERCHANGEABLE MAGNETIC FILTER

(71) Applicants: Alexis Victoria Mason, Englewood, FL (US); Dennis Gregory Mason, Englewood, FL (US)

(72) Inventors: Alexis Victoria Mason, Englewood, FL (US); Dennis Gregory Mason, Englewood, FL (US)

( * ) Notice: Subject to any disclaimer, the term of this patent is extended or adjusted under 35 U.S.C. 154(b) by 0 days.

(21) Appl. No.: 17/197,190

(22) Filed: Mar. 10, 2021

(51) Int. Cl.
*A61B 19/00* (2006.01)
*A41D 13/11* (2006.01)

(52) U.S. Cl.
CPC ..... *A41D 13/1161* (2013.01)

(58) Field of Classification Search
CPC ..... A41D 13/1161; A41D 13/11; A41D 13/1107; A41D 13/1138; A41D 13/1169; A41D 13/1176; A41D 13/1192; A41D 13/1115; A41D 13/1123; A41D 13/113; A41D 13/1146; A41D 13/1153; A41D 13/1184; A62B 7/10; A62B 9/04; A62B 23/025
USPC ..... 128/863; 2/9, 206
See application file for complete search history.

*Primary Examiner* — Victoria J Hicks
(74) *Attorney, Agent, or Firm* — Tiffany C. Miller; Inventions International Inc.

(57) ABSTRACT

A face covering having a support structure with a first magnet and a second magnet. The support structure has a fastener mechanism configured to orient the support structure in an open orientation during installation and a closed orientation during use. The support structure has a first protrusion having a first magnetic portion. The support structure has a second protrusion having a second magnetic portion. The support structure has a third protrusion having a third magnetic portion. The fastener mechanism of the support structure is formed from the magnetic connection between the first magnetic portion of the first protrusion, the second magnetic portion of the second protrusion, and the third magnetic portion of the third protrusion. A barrier member has a first filter layer connected to a layer of material. A magnetic snap rivet has a rivet portion removably connected to a post stud. The post stud retains a magnet.

4 Claims, 5 Drawing Sheets

FACE COVERING WITH INTERCHANGEABLE MAGNETIC FILTER

BACKGROUND OF THE INVENTION

1. Field of the Invention

This innovation relates, generally, to a face covering. More particularly, it relates to a face shield having a removable barrier layer with a filter in magnetic communication with a support frame.

2. Background Art

Currently, face coverings such as face shields and face masks in today's market are secured to a user's face with straps configured to wrap around a user's ears, resulting in a build-up of pressure at the ear and other pressure points on the face followed by pain. The COVID-19 pandemic has led to the widespread use of face coverings in attempt to slow the spread of SARS-CoV-2 virus transmission. Users such as healthcare professionals, students, business employees, patrons, factory workers, or any person required and/or volunteering to wear a face covering may have experienced pain and discomfort from wearing face coverings for short and/or long periods of time. Thus, there is a need for a face covering constructed to distribute the weight of the face covering throughout the frame support in an attempt to reduce the force of the face covering applied to pressure points on a user's face during use.

Further, many individuals wear accessories such as earbuds and glasses, which often shift out of alignment and/or fall off during use, which may result in damage to the accessory and render the device inoperable for its intended purpose. Some activities require the use of eyewear such as in the construction field or at industrial factories and the combination of wearing both eyewear and a face covering may cause discomfort and pain to the user especially when worn for a length of time being pressed on a user's face. There is a need for a face covering configured to connect to and to support accessories such as eyeglasses and/or earbuds to retain them on a user during use to minimize this discomfort.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a face covering having a support structure having a first magnet and a second magnet. The support structure of the face covering has a fastener mechanism configured to orient the support structure in an open orientation during installation and a closed orientation during use to retain the face covering onto a user's face. The support structure has a first protrusion having a first magnetic portion. The support structure has a second protrusion having a second magnetic portion. The support structure has a third protrusion having a third magnetic portion. The fastener mechanism of the support structure is formed from the magnetic connection between the first magnetic portion of the first protrusion, the second magnetic portion of the second protrusion, and the third magnetic portion of the third protrusion. A barrier member has a first filter layer connected to a layer of material. A magnetic snap rivet has a rivet portion removably connected to a post stud. The post stud retains a magnet. The first filter layer of the barrier member is connected to a first magnetic snap rivet. The layer of material of the barrier member is connected to a second magnetic snap rivet. The first magnetic snap rivet of the first filter layer of the barrier member is magnetically connected to the first magnet of the support structure. The second magnetic snap rivet of the layer of material of the barrier member is magnetically connected to the second magnet of the support structure. It is within the scope of this current invention for the face covering to have a first filter layer connected to a removable filter. In a preferred embodiment, the second protrusion and third protrusion are is surrounded by a magnetic coil, and which also includes improvements that overcome the limitations of prior art face coverings are now met by a new, useful, and non-obvious invention.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
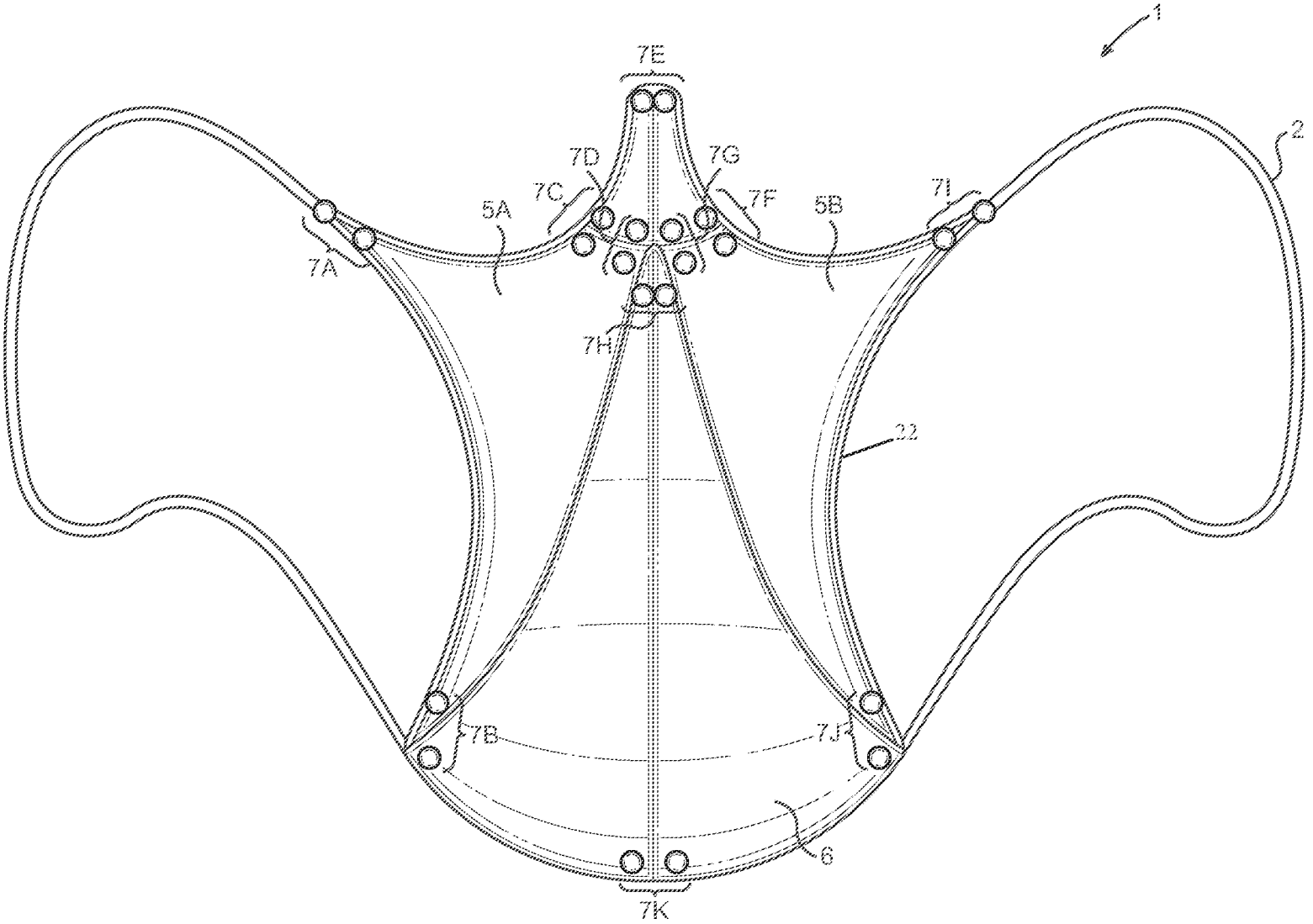
FIG. 1 is a front perspective view of the novel face covering having a support structure retaining a barrier member having a plurality of rivet portions of magnetic snap rivets connected thereto.
Figure 2:
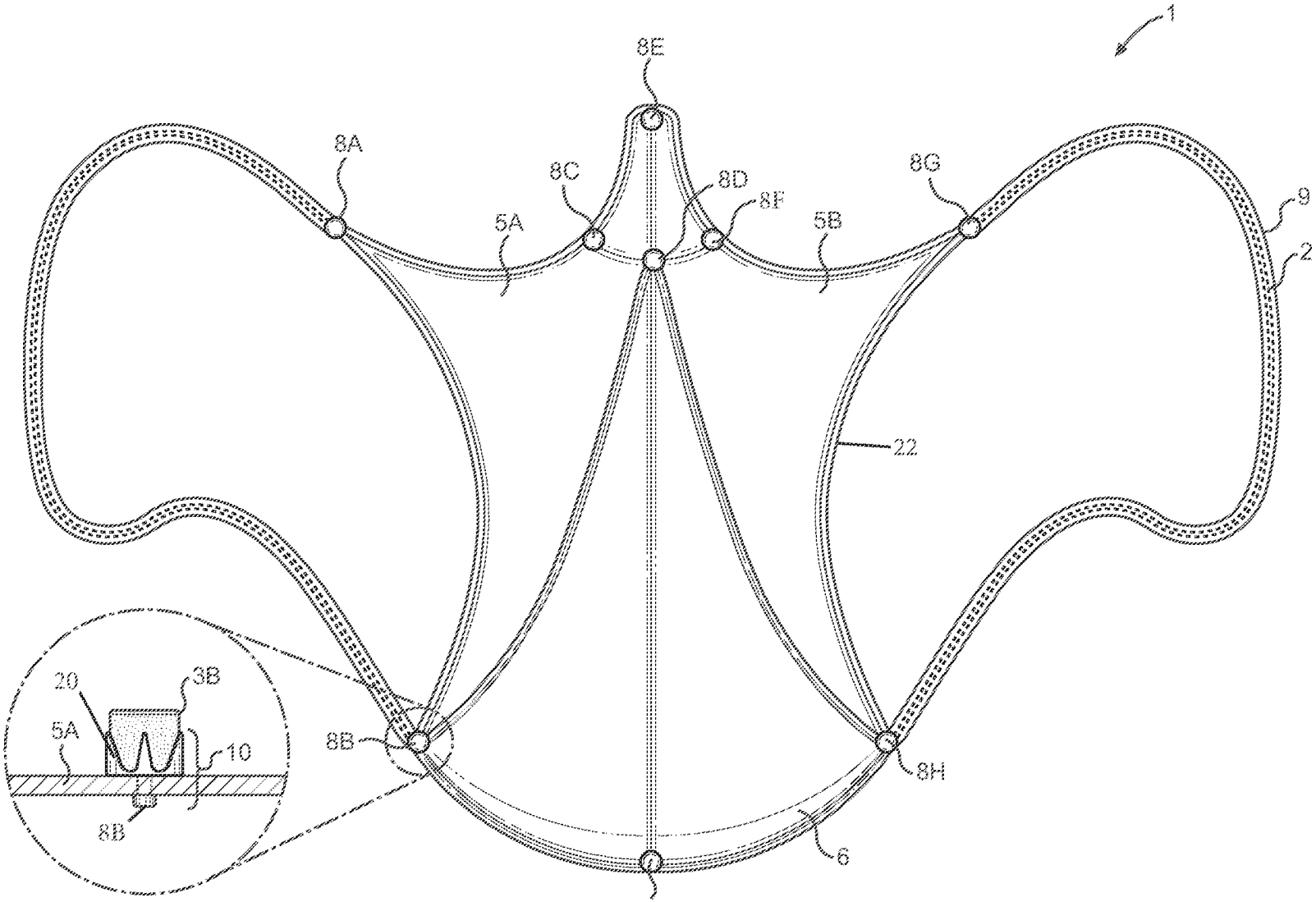
FIG. 2 is a front perspective view of the novel face covering having a support structure retaining a barrier member having a plurality of post studs retaining a magnet of magnetic snap rivets connected thereto.
Figure 3:
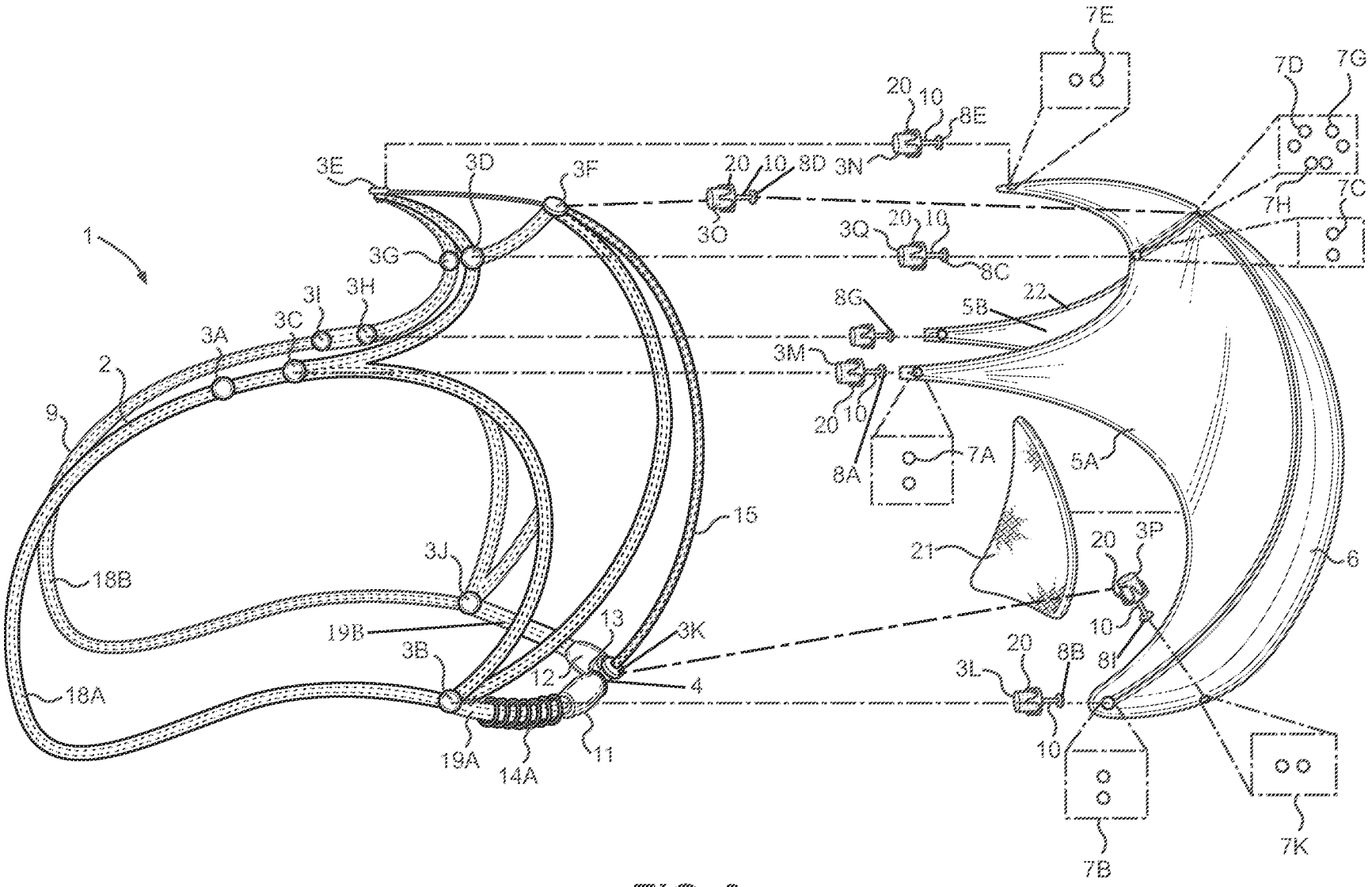
FIG. 3 is an exploded side view of the novel face covering having a support structure having a plurality of magnets configured to connect to a plurality of magnetic snap rivets of the barrier member.

FIGS. 1-3 illustrate face covering 1 having support structure 2 magnetically connected to removable barrier member 22 (FIGS. 2-3). It is within the scope of this invention for support structure 2 to be made of any magnetic material including, but not limited to, a metal, stainless steel, or galvanized steel. Support structure 2 may be covered with layer of material 9. Layer of material 9 (FIG. 3) is any material such as rubber, a gel, silicone, fabric, foam, polypropylene, or any material capable of providing a comfortable barrier between support structure 2 and the skin of a user when being worn by a user. Removable barrier member 22 is made of first filter layer 6 connected to layer of material 5A and 5B. It is within the scope of this invention for first filter layer 6 and/or second filter layer 21 (FIG. 3) to be made of any antiviral and/or antibacterial material including, but not limited to, a copper mesh, a copper screen, and/or polypropylene. In an example, first filter layer 6 may be positioned between first portion of layer of material 5A and second portion of layer of material 5B. First layer of material 5A and second layer of material 5B are connected at barrier member 22 portion that overlays a user's nose when in use. It is within the scope of this invention for layer of material 5A and 5B to be made of any material including, but not limited to, vinyl, fabric, cotton, polyester, spandex, metal, silicone, and/or rubber.

FIG. 1 illustrates support structure 22 having magnetic rivet connection points 7A-7K having at least a portion of each section connected to an outer perimeter edge of barrier member 22. In particular, magnetic rivet portions 7A, 7C, and 7D each have two magnetic rivets that are connected to first layer of material 5A. It is within the scope of this invention for magnetic rivet 7A-7K to be made of any magnetic material including, but not limited to, any magnet such as N35 neodymium, and/or N52 neodymium. In a preferred embodiment, the shape of magnetic rivet 7A-7K includes, but is not limited to, a cylinder, a plate, or a disc shape. At least one magnet of magnetic rivet section 7B is connected to first layer of material 5A and first filter layer 6. Magnetic rivet section 7K has two portions or two magnetic rivets that are both connected to first filter layer 6. Magnetic rivet section 7H has two portions or two magnetic rivets that are both connected to first filter layer 6.

Referring again to FIG. 1, at least one magnet of magnetic rivet section 7J is connected to second layer of material 5B and first filter layer 6. Magnetic rivet portions 7F, 7G, and 7I each have two magnetic rivets that are connected to second layer of material 5B. At least one magnet of magnetic rivet section 7E is connected to first material layer 5A and second layer of material 5B. In this embodiment, weight distribution of the magnetic rivet portions are specifically positioned to overlay pressure points of a user's face when the novel face covering is worn by a user to reduce pain and discomfort during use. The pair of rivets achieve the ideal weight distribution throughout a plurality of connection locations on the barrier member 22, when overlaying a user's face so that the majority of the weight of the face covering is not applied to one or two areas only. In particular, magnetic rivet section locations are predominantly configured to overlay support structure 2 which overlays a user's face cheeks, both sides of the jaw, chin, and nose.

FIGS. 2 and 3 illustrate novel face covering 1 having support structure 2 removably connected to barrier member 22 with magnetic snap rivets 8A-8I. Magnetic snap rivet 8 has post stud 10 having a first end located opposite a second end. The first end of post stud 10 has magnet 3. Post stud 10 can have adhesive, projections 20, or wings to retain magnet 3 within post stud 10. The second end of post stud 10 has rivet 8 removably connected thereto. The shaft of post stud 10 penetrates barrier member 22 at various locations, such as through first layer of material 5A, and is retained in place when rivet 8 is connected to second end of post stud. The rivet 8 is positioned on barrier member 22 at an orientation away from support structure 2 so that magnet 3 is positioned toward support structure 2. Rivet 8 is magnetized and is configured to be in magnetic communication with at least one magnet of magnetic rivet section 7 for maximum weight distribution of support structure 2 when face covering 1 is in use.

Referring now to FIG. 3, second filter layer 21 is removably connected to an inner wall surface of first filter layer 6 of barrier member 22. Magnetic rivet portion 7A substantially overlays the area of rivet 8A on barrier member 22 with post stud 10 retaining magnet 3M. Magnet 3M is magnetically connected to magnet 3C of support structure 2. Magnetic rivet portion 7B substantially overlays the area of rivet 8B with post stud 10 retaining magnet 3L. Magnet 3L is magnetically connected to magnet 3B of support structure 2. Magnetic rivet portion 7C substantially overlays the area of rivet 8C with post stud 10 retaining magnet 3Q. Magnet 3Q is magnetically connected to magnet 3D of support structure 2. Magnetic rivet portions 7D, 7G, and 7H substantially overlay the area of rivet 8D with post stud 10 retaining magnet 3O. Magnet 3O is magnetically connected to magnet 3F of support structure 2. Magnetic rivet portion 7E substantially overlays the area of rivet 8E with post stud 10 retaining magnet 3N. Magnet 3N is magnetically connected to magnet 3E of support structure 2.

Referring again to FIG. 3, magnetic rivet portion 7F (not shown) substantially overlays the area of a rivet with a post stud retaining a magnet connected to magnet 3G of support structure 2. Magnetic rivet portion 7I (not shown) substantially overlays the area of rivet 8G with post stud 10 retaining a magnet that is magnetically connected to magnet 3H of support structure 2. Magnetic rivet portion 7J (not shown) substantially overlays the area of a rivet with a post stud retaining a magnet that is magnetically connected to magnet 3J of support structure 2. Magnetic rivet portion 7K substantially overlays the area of rivet 8I with post stud 10 retaining magnet 3P. Magnet 3P is magnetically connected to magnet 3K of support structure 2. It is within the scope of this invention for support structure 2 to have a plurality of magnets such as 3A and 3C that are configured to magnetically connect with magnet 3M of barrier member 22. It is within the scope of this invention for support structure 2 to have a plurality of magnets such as 3H and 3I that are configured to magnetically connect with a magnet of barrier member 22.

Figure 4:
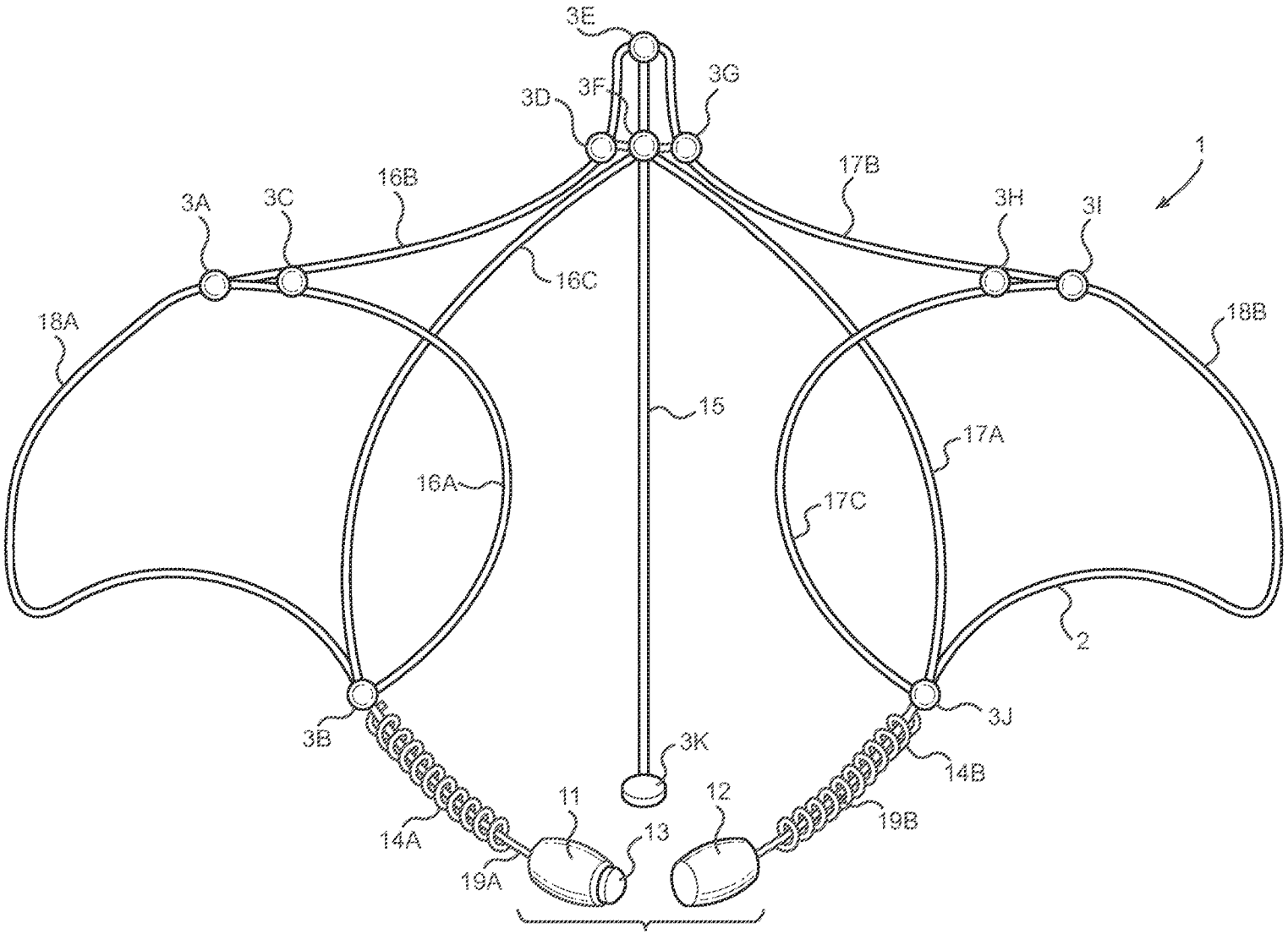
FIG. 4 is a front perspective view of the novel face covering having a support structure connected to a magnetic fastener mechanism oriented in an open configuration; and, FIG. 5 is a front perspective view of the novel face covering having a support structure connected to a magnetic fastener mechanism oriented in a closed configuration.
Figure 5:
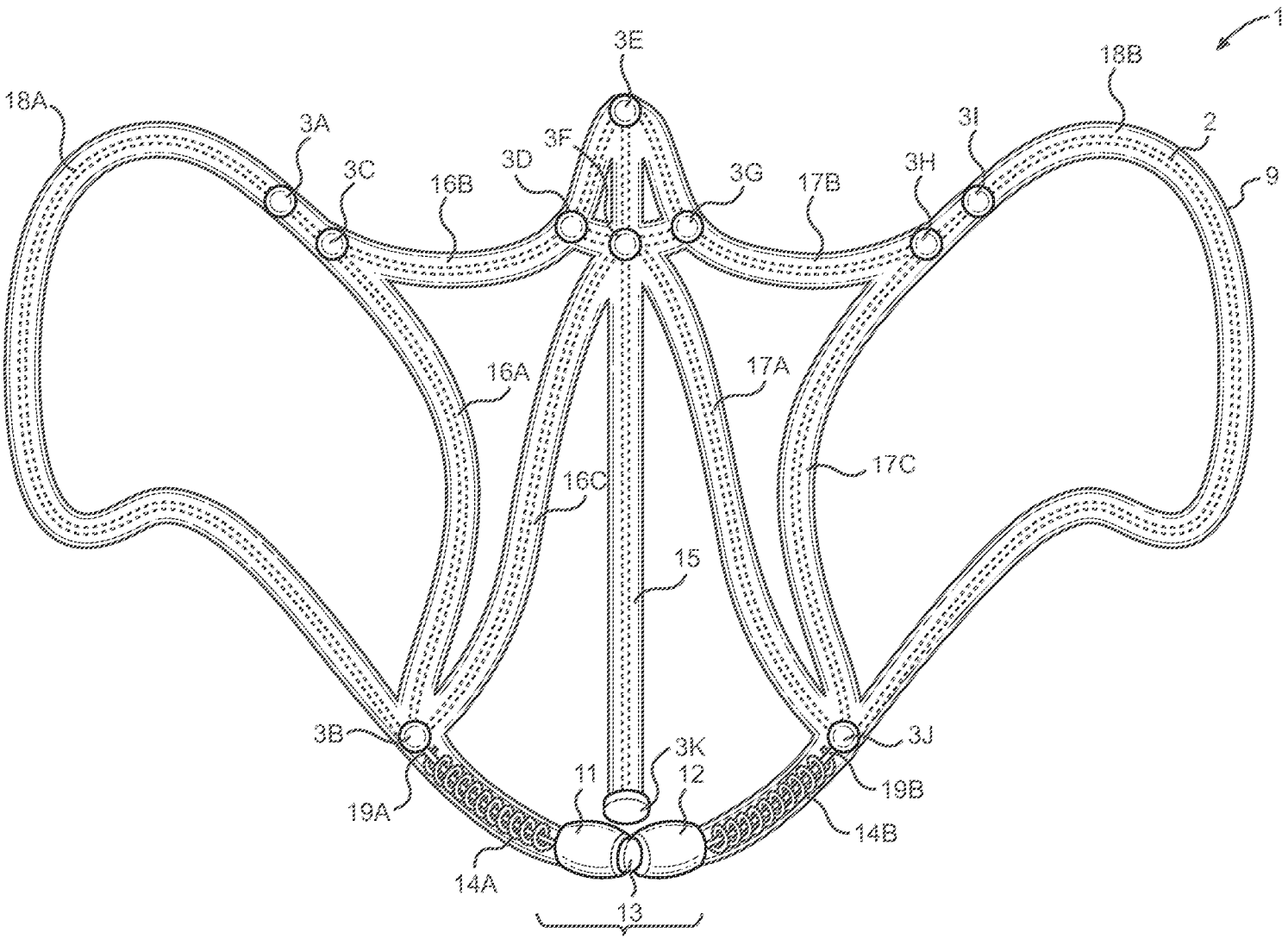

Referring now to FIGS. 3-5, face covering 1 has support structure 2 overlayed with layer of material 9 (FIGS. 3 and 5). Support structure 2 is connected to magnets 3A-3K. Support structure 2 has first protrusion 15 extending from magnet 3F overlaying the tip of a user's nose to magnet 3K located overlaying a user's neck when being worn by a user. Support structure 2 has fastener mechanism 4 configured to orient support structure 2 in an open orientation (FIG. 4) during installation and a closed orientation (FIGS. 3 and 5) during use. Support structure 1 has first protrusion 15 having first magnetic portion 3K. Support structure 2 has second protrusion 19A extending from magnet 3B. Second protrusion 19A has an end with at least one second magnetic portion 11 and 13. Support structure 2 has third protrusion 19B extending from magnet 3J. Third protrusion 19B has third magnetic portion 12 located on an end portion of third protrusion 19B.

Fastener mechanism 4 of support structure 4 is formed from the magnetic connection between first magnetic portion 3K of first protrusion 15 with second magnetic portion 11 and 13 of second protrusion 19A, and with third magnetic portion 12 of third protrusion 19B. In a preferred embodiment, second protrusion 19A is surrounded by magnetic coil 14A (FIG. 3-5) and third protrusion 19B is surrounded by magnetic coil 14B (FIGS. 4-5). Magnetic coils 14A and 14B therapeutically distribute the weight of face covering 1 onto support structure 2 and serve as a magnetic docking site for at least one rivet of magnetic rivet connection points 7B, 7J, and 7K and/or magnets of post stud 10. Magnetic coils 14A and 14B also serve to enhance the resiliency of the second protrusion 19A and third protrusion 14B so that they can more easily deform to orient fastening mechanism 4 in an open and closed orientation during installation and removal of face covering 1 onto a user's face.

Referring to FIGS. 4-5, support structure 2 has border frame 16A-16C of layer of material 5A (FIG. 3) and has border frame 17A-17C of layer of material 5B (FIG. 3). FIGS. 3-5 illustrate first radiused ear portion 18A extends from magnet 3A and ends through magnet 3B of second protrusion 19A. Second radiused ear portion 18B extends from magnet 3I and ends through magnet 3J of third protrusion 19B. The radiused structure of this ear portion 18A-18B is significant in that it can fully surround a user's ear as a means to fasten face covering 1 onto a user's head.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

The invention claimed is:

1. A face covering, comprising:

a support structure, said support structure having a first magnet and a second magnet, said support structure having a fastener mechanism configured to orient said support structure in an open orientation during installation and a closed orientation during use, said support structure has a first protrusion, said first protrusion has a first magnetic portion, said support structure has a second protrusion, said second protrusion has a second magnetic portion, said support structure has a third protrusion, said third protrusion has a third magnetic portion;

said fastener mechanism of said support structure is formed from the magnetic connection between said first magnetic portion of said first protrusion, said second magnetic portion of said second protrusion, and said third magnetic portion of said third protrusion;

a barrier member, said barrier member having a first filter layer connected to a layer of material;

a magnetic snap rivet, said magnetic snap rivet having a rivet portion removably connected to a post stud, said post stud retaining a magnet, said first filter layer of said barrier member is connected to a first magnetic snap rivet, said layer of material of said barrier member is connected to a second magnetic snap rivet; and, said first magnetic snap rivet of said first filter layer of said barrier member is magnetically connected to said first magnet of said support structure, said second magnetic snap rivet of said layer of material of said barrier member is magnetically connected to said second magnet of said support structure.

2. The face covering of claim 1, wherein said first filter layer is connected to a removable filter.

3. The face covering of claim 1, wherein said second protrusion is surrounded by a magnetic coil.

4. The face covering of claim 1, wherein said third protrusion is surrounded by a magnetic coil.

* * * * *